US009883577B2

(12) United States Patent
Konish et al.

(10) Patent No.: US 9,883,577 B2
(45) Date of Patent: Jan. 30, 2018

(54) BELT-SHAPED NEUTRON SOURCE

(71) Applicant: Neutron Therapeutics, Inc., Danvers, MA (US)

(72) Inventors: Steven P. Konish, Peabody, MA (US); Theodore H. Smick, Gloucester, MA (US)

(73) Assignee: Neutron Therapeutics, Inc., Danvers, MA (US)

( * ) Notice: Subject to any disclaimer, the term of this patent is extended or adjusted under 35 U.S.C. 154(b) by 30 days.

(21) Appl. No.: 15/495,052

(22) Filed: Apr. 24, 2017

(65) Prior Publication Data

US 2017/0318656 A1 Nov. 2, 2017

Related U.S. Application Data

(60) Provisional application No. 62/328,093, filed on Apr. 27, 2016.

(51) Int. Cl.
*H05H 3/06* (2006.01)

(52) U.S. Cl.
CPC ..... *H05H 3/06* (2013.01)

(58) Field of Classification Search
CPC ..... H05H 3/06
USPC ..... 250/251; 376/111, 114, 115
See application file for complete search history.

(56) References Cited

U.S. PATENT DOCUMENTS 3,305,684 A * 2/1967 Hopkinson ..... G01V 5/08 250/423 R
2003/0234355 A1* 12/2003 Leung ..... H05H 3/06 250/251

* cited by examiner

*Primary Examiner* — Michael Maskell
(74) *Attorney, Agent, or Firm* — DLA Piper LLP (US)

(57) ABSTRACT

A continuous, thin layer of neutron source material, for example solid lithium, is formed into a belt. The belt is continuously advanced in front of a proton source to generate neutrons from the lithium target. Additionally, the belt is continuously cooled, as it passes through a gas cooling section. Through the continuous motion and cooling of the lithium target, the belt can provide an effective neutron source without melting the target neutron source material.

20 Claims, 8 Drawing Sheets

BELT-SHAPED NEUTRON SOURCE

CROSS-REFERENCE TO RELATED APPLICATION

This application claims priority to and the benefit of U.S. Provisional Application No. 62/328,093 filed on Apr. 27, 2016, the disclosure of which is incorporated herein by reference in its entirety.

FIELD

The present disclosure relates to the methods and systems for generating neutrons using a neutron source material.

BACKGROUND

Accelerator-based neutron sources have many potential applications, including medical treatments, isotope production, explosive/fissile materials detection, assaying of precious metal ores, imaging, and others. A particular area of interest is boron neutron capture therapy (BNCT), which is a cancer treatment technique in which boron is preferentially concentrated in a patient's malignant tumor and a neutron beam is aimed through the patient at the boron-containing tumor. When the boron atoms capture a neutron, particles are produced having sufficient energy to cause severe damage to the tissue in which it is present. The effect is highly localized, and, as a result, this technique can be used as a highly selective cancer treatment method, effecting only specifically targeted cells.

One of the most commonly proposed neutron target materials for these types of systems is lithium, which reacts upon treatment with protons to produce neutrons through the reaction $^{7}Li(p,n)^{7}Be$. This reaction has a high neutron yield and produces neutrons of modest energy, desirable for many applications.

However, since the energy of the proton beam is dissipated as heat in the target, the heat must be removed before the target is destroyed. Two primary approaches have been proposed for heat removal. The first is a stationary solid target, intensively cooled, mainly through water cooling, from the backside. The second is a liquid target in which the proton beam impinges on a flowing jet of liquid source material. Both of these approaches have significant drawbacks, particularly when lithium is used as the neutron source/target. Lithium has a relatively low melting temperature (180° C.) and a relatively low thermal conductivity, which makes it very challenging to remove the heat from a solid target without overheating and melting the surface. In addition, exposure to intense proton beams can quickly lead to blistering of the solid lithium, requiring frequent target replacement. Furthermore, lithium is highly reactive with water, so a water cooling system can be problematic if a malfunction occurs.

While liquid target solutions have been described, these, in general, suffer from slow heat-up times and potential solidification of flowing lithium if the temperature in the circuit drops too low, causing the charge of lithium to be inadvertently diverted into the target chamber. Flowing liquid lithium approaches also require a large amount of lithium to fill up the circuit, pump, and heat exchanger, which leads to both high cost and a significant safety hazard from the highly reactive liquid lithium.

SUMMARY

The present disclosure relates to a method and a system for generating a flux of neutrons. A continuous, thin layer of neutron source material, for example solid lithium, is formed into a belt. The belt is continuously advanced in front of a proton source to generate neutrons from the lithium target. Additionally, the belt is continuously cooled, as it passes through a gas cooling section. Through the continuous motion and cooling of the lithium target, the described belt can provide an effective neutron source without melting the target neutron source material.

In some embodiments, a neutron generation method can comprise generating a proton beam and advancing a belt-shaped neutron source in a path of the proton beam to generate a flux of neutrons. The belt-shaped neutron source can comprise a neutron source material. The neutron source material can comprise lithium, beryllium, or a combination thereof. In some embodiments, the method can further comprise supporting the belt-shaped neutron source with a support belt.

In some embodiments, the neutron generation method can comprise focusing the flux of neutrons with a beam-shaping assembly. The beam-shaping assembly can comprise a neutron moderating material. The neutron moderating material can comprise elements such as magnesium, aluminum, fluorine, etc. In some embodiments, the method can further comprises surrounding the beam-shaping assembly with a neutron reflector. The neutron reflector can comprise lead, bismuth, or a combination thereof.

In some embodiments, the neutron generation method can comprise cooling the belt-shaped neutron source by passing the belt-shaped neutron source through a cooling section. In some embodiments, the method can further comprise cooling the belt-shaped neutron source with a cooling gas. The cooling gas can comprise helium, argon, hydrogen, nitrogen, or a combination thereof.

In some embodiments, the neutron generation method can comprise supporting the belt-shaped neutron source by a pulley and tensioning the belt-shaped neutron source by a pivot arm.

In some embodiments, a neutron generation system can comprise a proton beam generator for generating a proton beam and a belt-shaped neutron source configured to travel through the proton beam to generate a flux of neutrons. The belt-shaped neutron source can comprise a neutron source material. The neutron source material can comprise lithium, beryllium, or a combination thereof. In some embodiment, the belt-shaped neutron source can further comprise a support belt.

In some embodiments, the neutron generation system can comprise a beam-shaping assembly configured to focus the flux of neutrons. The beam-shaping assembly can comprise a neutron moderating material. The neutron moderating material can comprise elements such as magnesium, aluminum, fluorine, etc. In some embodiments, the system can further comprise a neutron reflector surrounding the beam-shaping assembly. The neutron reflector can comprise lead, bismuth, or a combination thereof.

In some embodiments, the neutron generation system can comprise a cooling section disposed on a path of the belt-shaped neutron source. The cooling section can comprise a gas for cooling the belt-shaped neutron source. The gas can comprise helium, argon, hydrogen, nitrogen, or a combination thereof.

In some embodiments, the neutron generation system can comprise a pulley configured to support the belt-shaped neutron source and a pivot arm configured to tension the belt-shaped neutron source.

BRIEF DESCRIPTION OF THE DRAWINGS

Various objects, features, and advantages of the present disclosure can be more fully appreciated with reference to the following detailed description when considered in connection with the following drawings, in which like reference numerals identify like elements. The following drawings are for the purpose of illustration only and are not intended to be limiting.

DETAILED DESCRIPTION

The present disclosure relates to a solid belt neutron source. A continuous, thin layer of neutron source material, for example, solid lithium, is formed into a belt. The belt is continuously advanced in front of a proton source to generate neutrons from the lithium target. Additionally, the belt is continuously cooled, as it passes through one or more gas cooling sections. Through the continuous motion and cooling of the lithium target, the described belt can provide a high flux neutron source without melting the target neutron source material.

In order to generate the neutron flux required for BNCT, a lithium target should be exposed to a proton beam of about 100 kW. And, to prevent the lithium target from melting, the solid lithium targets need to be cooled. Complex machining of consumable components is often required to achieve this type and extent of cooling, which can be costly. Water cooling in the vacuum system can risk accidental exposure of the lithium to water, which can be dangerous. In addition, the consumable lithium target and any other activated components in the target area must be stored after use until they are no longer radioactive.

Figure 1A:
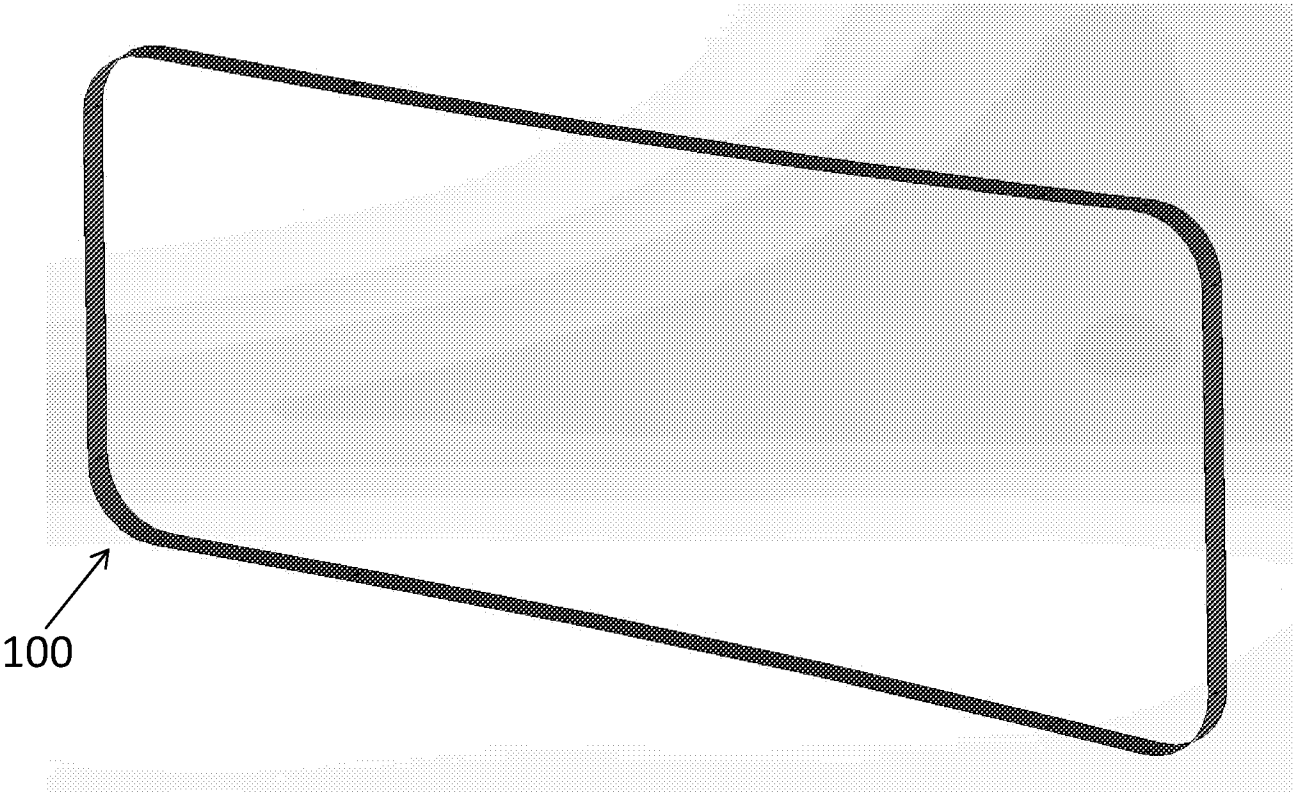
FIG. 1A depicts a perspective view of an exemplary belt-shaped neutron source, according to aspects of the present disclosure.
Figure 1B:
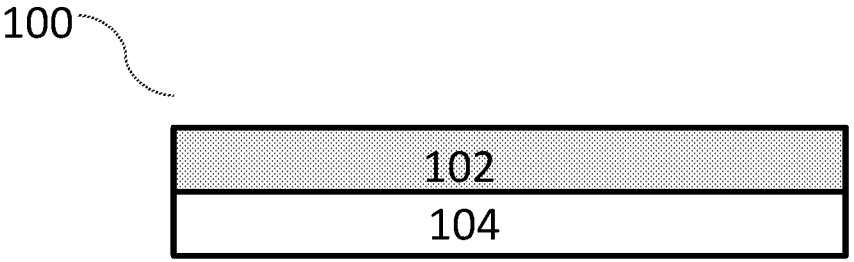
FIG. 1B depicts a cross section of an exemplary belt-shaped neutron source, according to aspects of the present disclosure.

To address these concerns and others, FIGS. 1A and 1B depict an exemplary belt-shaped neutron source 100, according to aspects of the present disclosure. FIG. 1B depicts a cross section of belt-shaped neutron source 100. In some embodiments, a continuous support belt 104 can be bonded to a strip of solid neutron source material 102. In some embodiments, support belt 104 can be plastic or metal. Support belt 104 can be any material that can be formed into an endless, belt shape, can be easily bonded to the neutron source material, does not react with the neutron source material, provides good thermal contact with the neutron source material, and provides structure. In some embodiments, support belt 104 can be copper or stainless steel. In some embodiments, support belt 104 can be a web or screen upon which neutron source material is sprayed, applied, or pressed. In some embodiments, no support belt is necessary and a continuous belt of neutron source material can be used without the belt. In some embodiments, neutron source material 102 can be lithium, beryllium or any other neutron material that produces neutrons when bombarded by a charged particle. In some embodiments, the support belt can be about 20 m to 50 m, e.g., about 30 m in length, about 100 mm to about 200 mm, e.g., about 150 mm wide, and about 0.1 mm to about 1.0 mm, e.g., about 0.25 mm thick and the target material about 0.1 mm to about 1.0 mm, e.g., about 0.4 mm thick. However, the size and dimensions of the belt can be modified to increase or decrease the length, width and thickness to adapt the belt to a particular application or apparatus. The support structure for the belt preferably contains at least two, and preferably at least four, cylindrical pulleys with a diameter that is large enough to prevent fatigue of the belt or damage to the neutron source material. This diameter is preferably at least about 500 mm. The axial dimension of the pulley is approximately the width of the belt. In some embodiments, these pulleys contact the support belt rather than the neutron source material so that the belt can substantially encompass some part of the charged particle beamline.

Figure 2A:
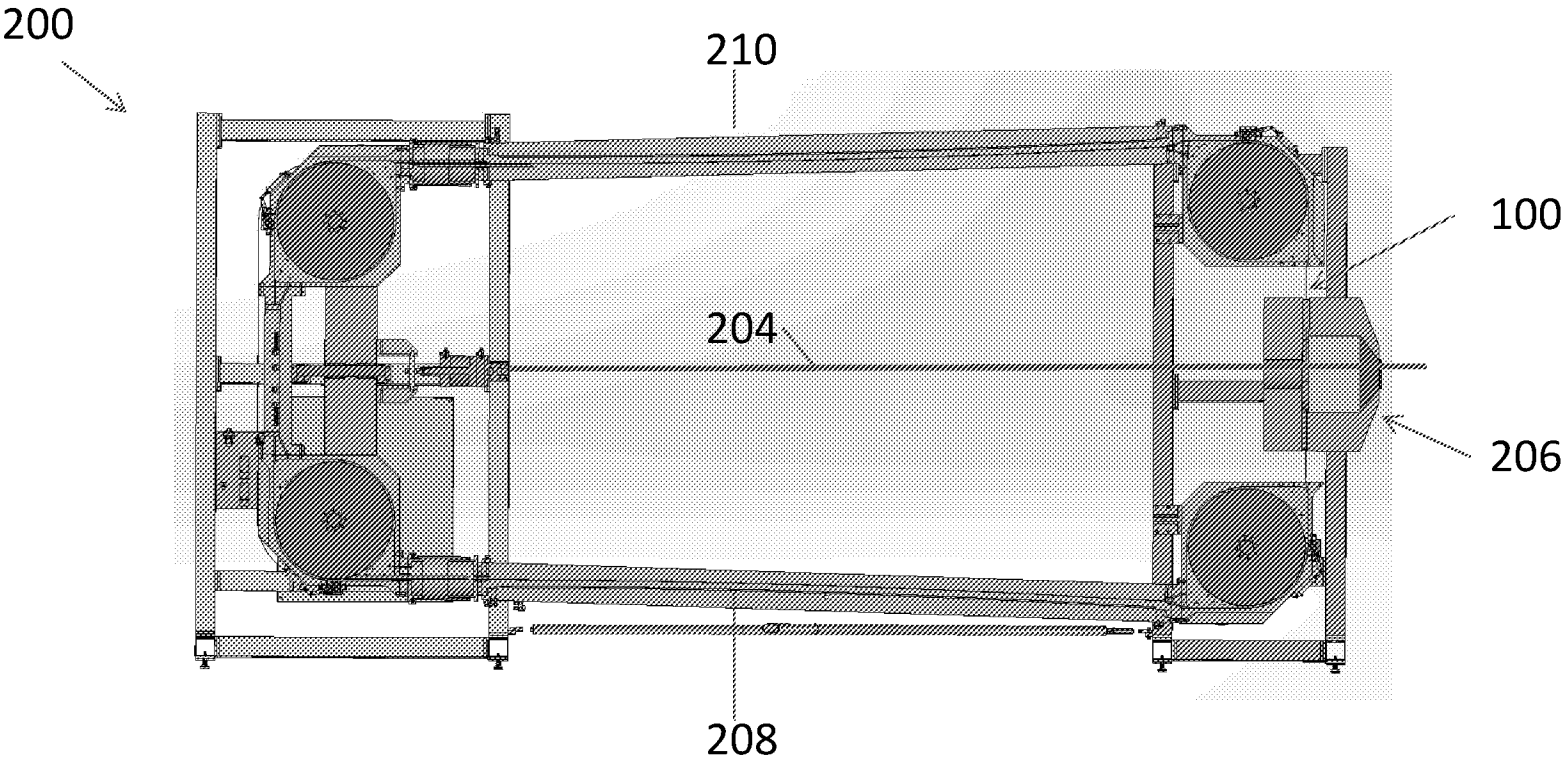
FIG. 2A depicts a side view of an exemplary neutron generation device, including a belt-shaped neutron source, according to aspects of the present disclosure.
Figure 2B:
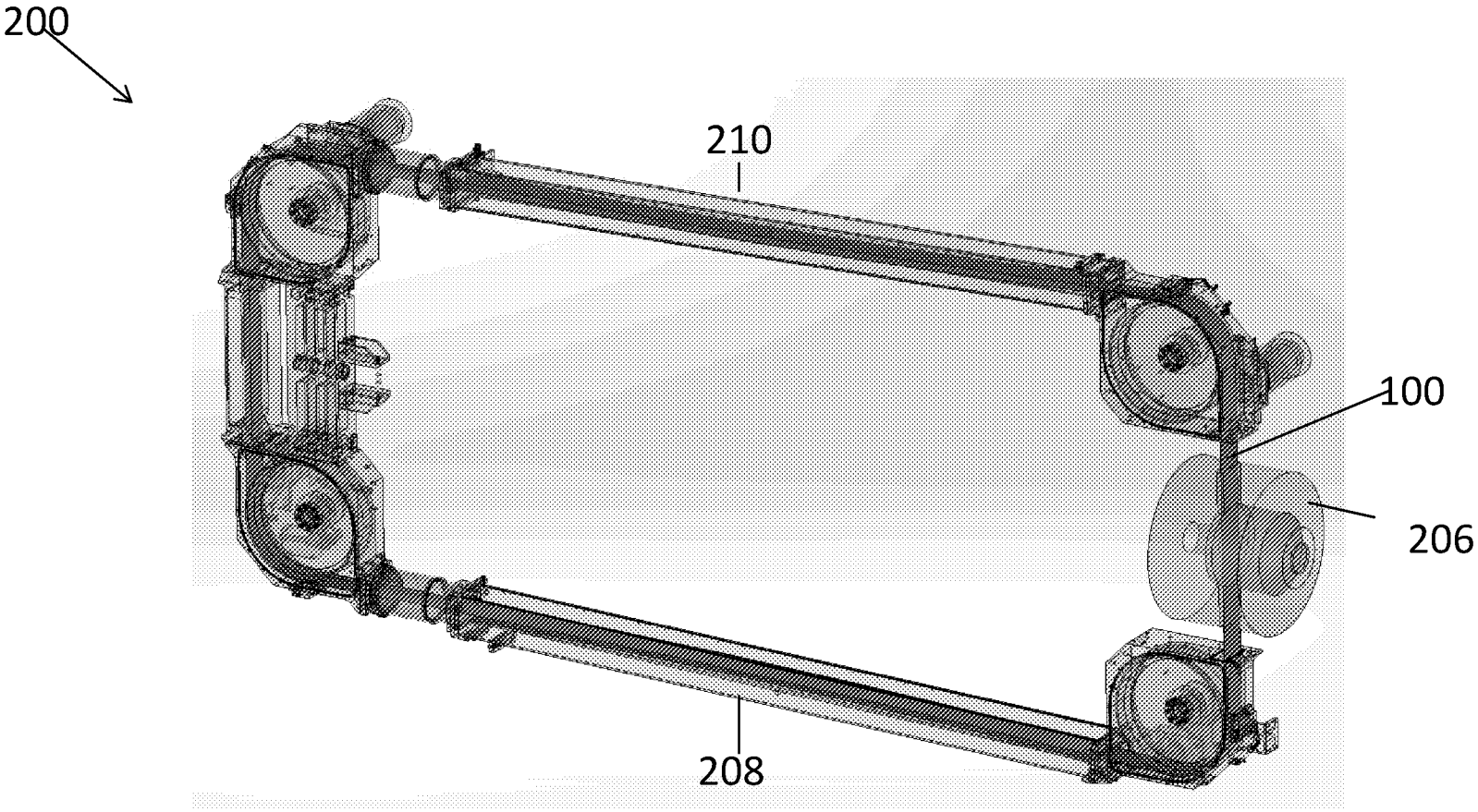
FIG. 2B depicts another view of an exemplary neutron generation device, including a belt-shaped neutron source, according to aspects of the present disclosure.

FIG. 2A depicts a side view of an exemplary neutron generation device 200, including a belt-shaped neutron source 100, according to aspects of the present disclosure. In some embodiments, belt-shaped neutron source 100 is run through a proton beam 204 and a beam-shaping assembly 206 to produce a neutron flux. Belt based neutron source 100 can be cooled as it runs through a first cooling arc 208 and a second cooling arc 210. Each cooling arc 208, 210 can cool belt-shaped neutron source 100 through gas cooling, using a suitable cooling gas, for example, helium, argon, hydrogen, or nitrogen. Cooling arcs 208, 210 will be discussed in more detail with respect to FIGS. 5 A and 5B. FIG. 2B depicts another view of an exemplary neutron generation device, including a belt-shaped neutron source, according to aspects of the present disclosure.

In some embodiments, proton beam 204 can be generated by a co-located particle accelerator. Beam-shaping assembly 206 can be used to focus and contain neutron flux produced from the interaction of proton beam 204 with belt-shaped neutron source 100. In some embodiments, beam-shaping assembly 206 and all that resides within it, may be a static (with the exception of the belt itself), uncooled device which contains the bulk of the neutron flux and thus prevents the activation of complex mechanisms or sensitive materials. When the neutron source material is lithium and the proton energy is about 2.4-2.8 MeV, beam-shaping assembly 206 may consist of about 250-400 mm of neutron moderating material extending beyond the belt (for example, composed primarily of the elements magnesium, aluminum, and fluorine, and having a density of approximately three g/cc), which is surrounded on all sides by preferably at least 20 cm of neutron reflector, which is composed preferably of lead or bismuth. The neutron reflector also can extend behind the belt, except for whatever aperture is required for the ingress of the proton beam. The belt can enter and exit beam-shaping assembly 206 through slits in the reflector, where the width of the slits is preferably less than about 25 mm and contains both the belt and the vacuum vessel. Thus, the belt systems can provide efficient containment and focusing of the neutron beam compared to other devices which may require larger penetrations in the reflector and therefore larger leakage of neutrons.

Figure 3:
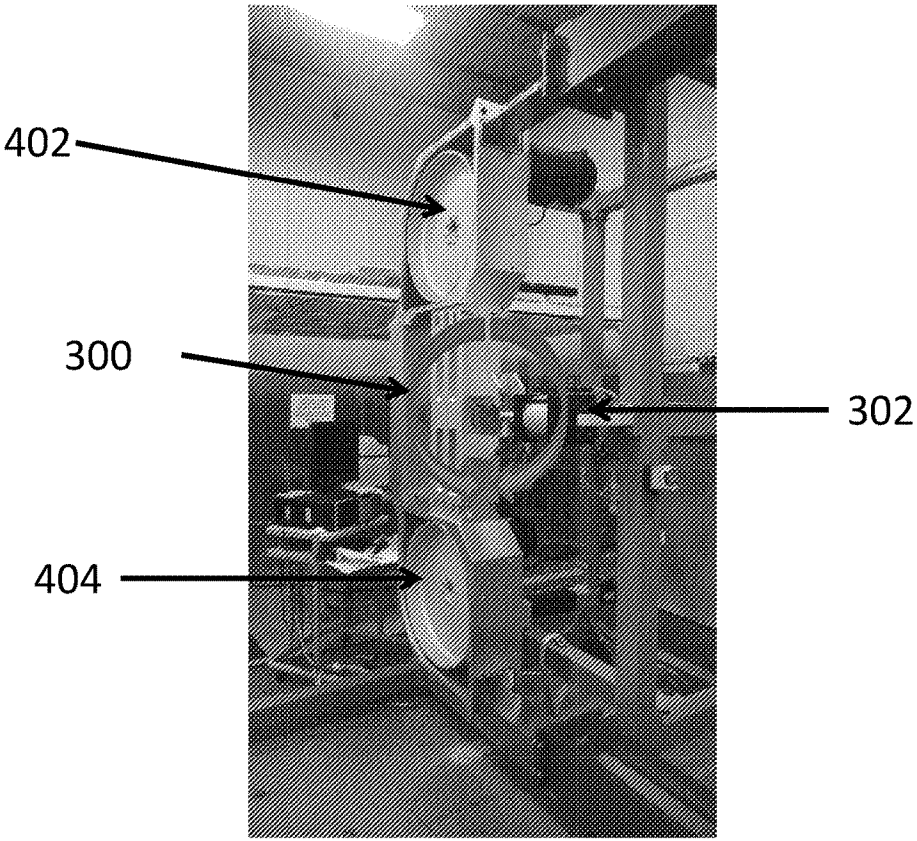
FIG. 3 depicts a perspective view of an exemplary neutron generation device, according to aspects of the present disclosure.
Figure 4:
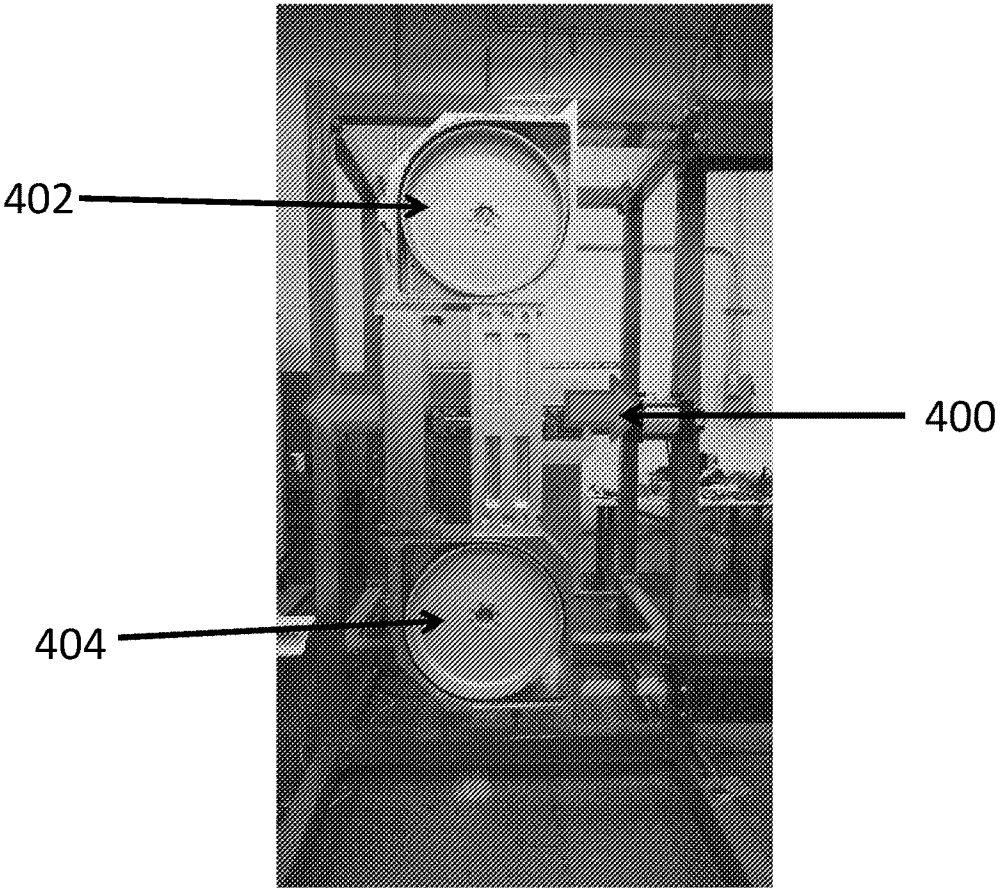
FIG. 4 depicts another perspective view of an exemplary neutron generation device, according to aspects of the present disclosure.

FIG. 3 depicts a perspective view of an exemplary neutron generation device, according to aspects of the present disclosure. Arrows 300 depict a tracking axis of pivot arm 302. FIG. 4 depicts another perspective view of an exemplary neutron generation device, according to aspects of the present disclosure. Arrow 400 depicts a tensioning axis of pivot arm 302. The position of the belt is actively tracked and displacements are corrected by feeding back on the tracking axis of the pivot arm 302. This can keep the belt centered on the pulleys and the charged particle beam. The belt can be tensioned through continuous adjustments to the tensioning axis of the rigid pivot arm 302.

In some embodiments, the entire belt path can be contained within a vacuum chamber. For example, the region of the belt path where belt-shaped neutron source 100 is exposed to a proton beam is in the about $10^{-7}$ torr vacuum range. The sections of belt path before and after proton beam 204 can contain differential pumping stages. In some embodiments, belt-shaped neutron source 100 can run through compliant seals before and after the differential pumping stages. The differential pumping stages can bring the rest of the belt path to a rough vacuum argon environment, with a significantly higher pressure than the charged particle beam environment.

Figure 5A:
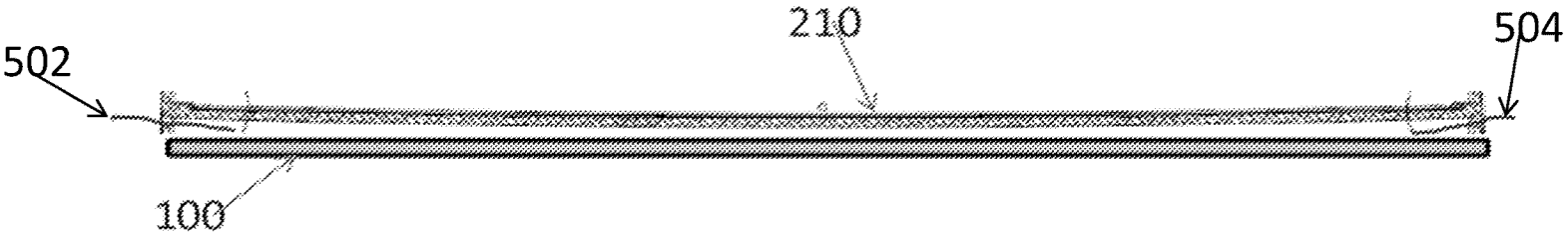
FIGS. 5A-5C depict a perspective views of exemplary cooling arcs, according to embodiments of the present disclosure.
Figure 5B:
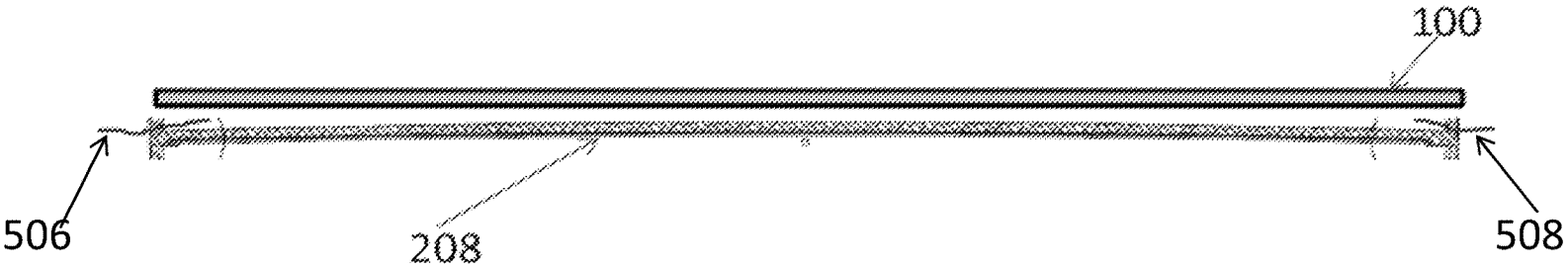
Figure 5C:
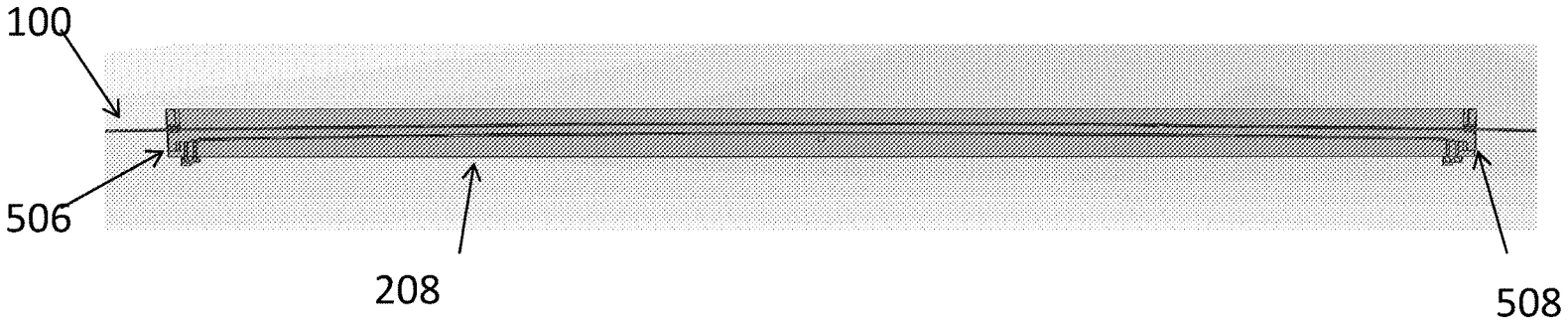

FIGS. 5A-5C depict a perspective view of exemplary cooling arcs, 210 and 208, according to embodiments of the present disclosure. As shown in FIGS. 5A and 5B, each cooling arc 208, 210 is slightly bowed towards belt-shaped neutron source 100. Belt-shaped neutron source 100 enters cooling arc 210 at opening 502 and exits cooling arc 210 at opening 504, then enters cooling arc 208 at opening 508 and exits cooling arc 208 at opening 506. And, each cooling arc 208, 210 and belt-shaped neutron source 100 are housed within a vacuum chamber, for example a vacuum of about 5 torr, which is significantly higher than the pressure in the area of the proton beam. In this environment, belt-shaped neutron source 100 can slide across cooling arcs 208, 210, at an appropriately determined tension to ensure contact with the cooling arcs 208, 210, provided by the pivot arms described in FIGS. 3 and 4. For example, belt-shaped neutron source 100 can be tensioned to contact the cooling arcs 208, 210. Cooling arcs 208, 210 can be made from aluminum, given an anodized hard coat, and treated with a low friction material, for example, tungsten disulfide. In some embodiments, cooling arcs 208, 210 can have a radius of curvature of about 60 m. The radius size is selected to flatten, smooth, or conform the belt-shaped neutron source 100, and not to stretch, distort, or damage belt-shaped neutron source 100. The tension, belt flatness and arc tolerance are designed to maintain a gap that is less than about 200 microns and preferably less than about 50 microns across the entire surface of the cooling arc.

In some embodiments, cooling arcs 208, 210 can be externally water cooled. Water lines remain outside of the vacuum and heat is conducted through the cooling arc wall so that the lithium is never exposed to water in the event of a water leak. The belt enters and exits these arcs tangentially so as to minimize wear across the belt. The belt can be cooled through molecular gas heat transfer between the belt and the water cooled arc. In some embodiments, the molecular gas can be argon, helium or another noble gas, nitrogen or hydrogen.

Once the neutron source material on a belt has reached its maximum dose, the activated belt can be automatically cut and wound into a spool. The spool can be automatically placed in a lead shielded container to prevent radiation exposure to service personnel, and sealed for storage until the radiation has fallen to levels where it is safe to perform permanent disposal. A new ribbon of neutron source material can be automatically threaded into the belt path and its end joined to form a new neutron source belt. Because the used neutron source material can be radioactive, and thereby dangerous to humans for some time after the neutron source has been depleted, the described belt-shaped neutron source has the advantage of a safe handling method and compact storage solution for spent neutron sources.

The described belt neutron source can treat many patients and can allow for low consumable cost per patient. This is because the described system and techniques reduce the amount of blistering of the neutron source, thus allowing longer target lifetimes and increased target service interval. As noted above, used belts can be rolled into a drum using the existing machine and can be easily stored until the radiation risks associated with the used neutron source materials have dissipated. Conversely, new belts can be easily threaded onto the machine. This automatic belt disposal and threading reduces machine downtime, increases patient throughput, and eliminates worker radiation exposure.

It is to be understood that the disclosed subject matter is not limited in its application to the details of construction and to the arrangements of the components set forth in the following description or illustrated in the drawings. The disclosed subject matter is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the disclosed subject matter. It is important, therefore, that the disclosure be regarded as including such equivalent constructions insofar as they do not depart from the spirit and scope of the disclosed subject matter.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter.

What is claimed is:

1. A neutron generation method comprising:

generating a proton beam;

advancing a belt-shaped neutron source in a path of the proton beam to generate a flux of neutrons;

focusing the flux of neutrons with a beam-shaping assembly; and cooling the belt-shaped neutron source by passing the belt-shaped neutron source through a cooling section.

2. The method of claim 1, wherein the belt-shaped neutron source comprises lithium, beryllium, or a combination thereof.

3. The method of claim 1, further comprising supporting the belt-shaped neutron source with a support belt.

4. The method of claim 1, further comprising cooling the belt-shaped neutron source with a cooling gas.

5. The method of claim 4, wherein the cooling gas comprises helium, argon, hydrogen, nitrogen, or a combination thereof.

6. The method of claim 1, further comprising moderating the flux of neutrons with a neutron moderating material in the beam-shaping assembly.

7. The method of claim 6, wherein the neutron moderating material comprises at least one element selected from the group consisting of magnesium, aluminum, and fluorine.

8. The method of claim 1, further comprising reflecting neutrons with a neutron reflector surrounding the beam-shaping assembly.

9. The method of claim 8, wherein the neutron reflector comprises lead, bismuth, or a combination thereof.

10. The method of claim 1, further comprising:

supporting the belt-shaped neutron source by a pulley; and tensioning the belt-shaped neutron source by a pivot arm.

11. A neutron generation system comprising:

a proton beam generator for generating a proton beam;

a belt-shaped neutron source configured to travel through the proton beam to generate a flux of neutrons;

a beam-shaping assembly configured to focus the flux of neutrons; and a cooling section disposed on a path of the belt-shaped neutron source.

12. The system of claim 11, wherein the belt-shaped neutron source comprises lithium, beryllium, or a combination thereof.

13. The system of claim 11 wherein the belt-shaped neutron source comprises a support belt.

14. The system of claim 11, wherein the cooling section comprises a gas for cooling the belt-shaped neutron source.

15. The system of claim 14, wherein the gas comprises helium, argon, hydrogen, nitrogen, or a combination thereof.

16. The system of claim 11, wherein the beam-shaping assembly comprises a neutron moderating material.

17. The system of claim 16, wherein the neutron moderating material comprises at least one element selected from the group consisting of magnesium, aluminum, and fluorine.

18. The system of claim 11, further comprising a neutron reflector surrounding the beam-shaping assembly.

19. The system of claim 18, wherein the neutron reflector comprises lead, bismuth, or a combination thereof.

20. The system of claim 11, further comprising:

a pulley configured to support the belt-shaped neutron source; and a pivot arm configured to tension the belt-shaped neutron source.

* * * * *